US006396027B1

(12) United States Patent
Wu

(10) Patent No.: US 6,396,027 B1
(45) Date of Patent: May 28, 2002

(54) PRESSING IRON WITH ELECTROLUMINESCENT TEMPERATURE STATUS INDICATOR

(75) Inventor: Tsan-Kuen Wu, Tainan Hsien (TW)

(73) Assignee: Tsann Kuen USA, Inc., Pasadena, CA (US)

( * ) Notice: Subject to any disclaimer, the term of this patent is extended or adjusted under 35 U.S.C. 154(b) by 0 days.

(21) Appl. No.: 09/919,027

(22) Filed: Jul. 31, 2001

(51) Int. Cl.[7] ..... D06F 75/00

(52) U.S. Cl. ..... 219/248; 219/251; 38/82; 116/202; 116/216; 313/511

(58) Field of Search ..... 219/248, 251, 219/245, 506; 38/74, 75, 82; 374/141, 152, 161, 162; 313/502, 503, 510, 511, 509; 116/216, 202, DIG. 35; 362/117, 119

(56) References Cited

U.S. PATENT DOCUMENTS 3,153,739 A * 10/1964 Graffenreid ..... 313/509
3,289,025 A * 11/1966 Bullinger ..... 313/507
3,325,664 A * 6/1967 Buck et al. ..... 313/507
6,150,636 A * 11/2000 Bogdanski et al. ..... 219/443.1

FOREIGN PATENT DOCUMENTS

| | | |
|---|---|---|
| EP | 603969 | * 6/1994 |
| GB | 1447092 | * 8/1976 |
| GB | 2289899 | * 12/1995 |
| JP | 61-263497 | * 11/1986 |
| JP | 62-142598 | * 6/1987 |
| JP | 3-181720 | * 8/1991 |

* cited by examiner

*Primary Examiner*—John A. Jeffery
(74) *Attorney, Agent, or Firm*—Darby & Darby

(57) ABSTRACT

A pressing iron includes a soleplate mounted on a bottom portion of a housing, an electroluminescent temperature status indicator mounted on an outer wall surface of the housing, and a control circuit mounted in the housing and coupled electrically to the soleplate and the temperature status indicator. The control circuit controls heating operation of the soleplate, and further controls light emitting activity of the temperature status indicator.

4 Claims, 4 Drawing Sheets

PRESSING IRON WITH ELECTROLUMINESCENT TEMPERATURE STATUS INDICATOR

BACKGROUND OF THE INVENTION

1. Field of the Invention

The invention relates to a pressing iron, more particularly to a pressing iron with an electroluminescent temperature status indicator.

2. Description of the Related Art

A conventional pressing iron includes a soleplate which is heated for ironing fabrics. Different types of fabrics have different ironing temperature limits. As such, conventional pressing irons are generally capable of providing different ironing temperatures to suit the characteristics of the fabric being ironed. Conventional pressing irons further include a number of temperature status indicators to provide a visual indication of the current ironing temperature of the soleplate. In a conventional pressing iron, different temperature status indicators are activated at different times to indicate low-temperature, medium-temperature and high-temperature operation of the soleplate. The temperature status indicator of a conventional pressing iron is usually in the form of a lamp, which has a relatively poor indicating effect due to a relatively small light radiating area thereof, and which has a relatively large electric power consumption.

SUMMARY OF THE INVENTION

Therefore, the object of the present invention is to provide a pressing iron with an electroluminescent temperature status indicator to overcome the aforesaid drawbacks associated with the use of lamps for status indication of the operating temperature of a soleplate.

According to the present invention, a pressing iron comprises a housing, a soleplate mounted on a bottom portion of the housing, an electroluminescent temperature status indicator mounted on an outer wall surface of the housing, and a control circuit mounted in the housing and coupled electrically to the soleplate and the temperature status indicator. The control circuit controls heating operation of the soleplate, and further controls light emitting activity of the temperature status indicator.

Preferably, the temperature status indicator includes a number of indicator members, each of which is formed as an electroluminescent plate and each of which is activated by the control circuit to emit light according to operating temperature of the soleplate.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
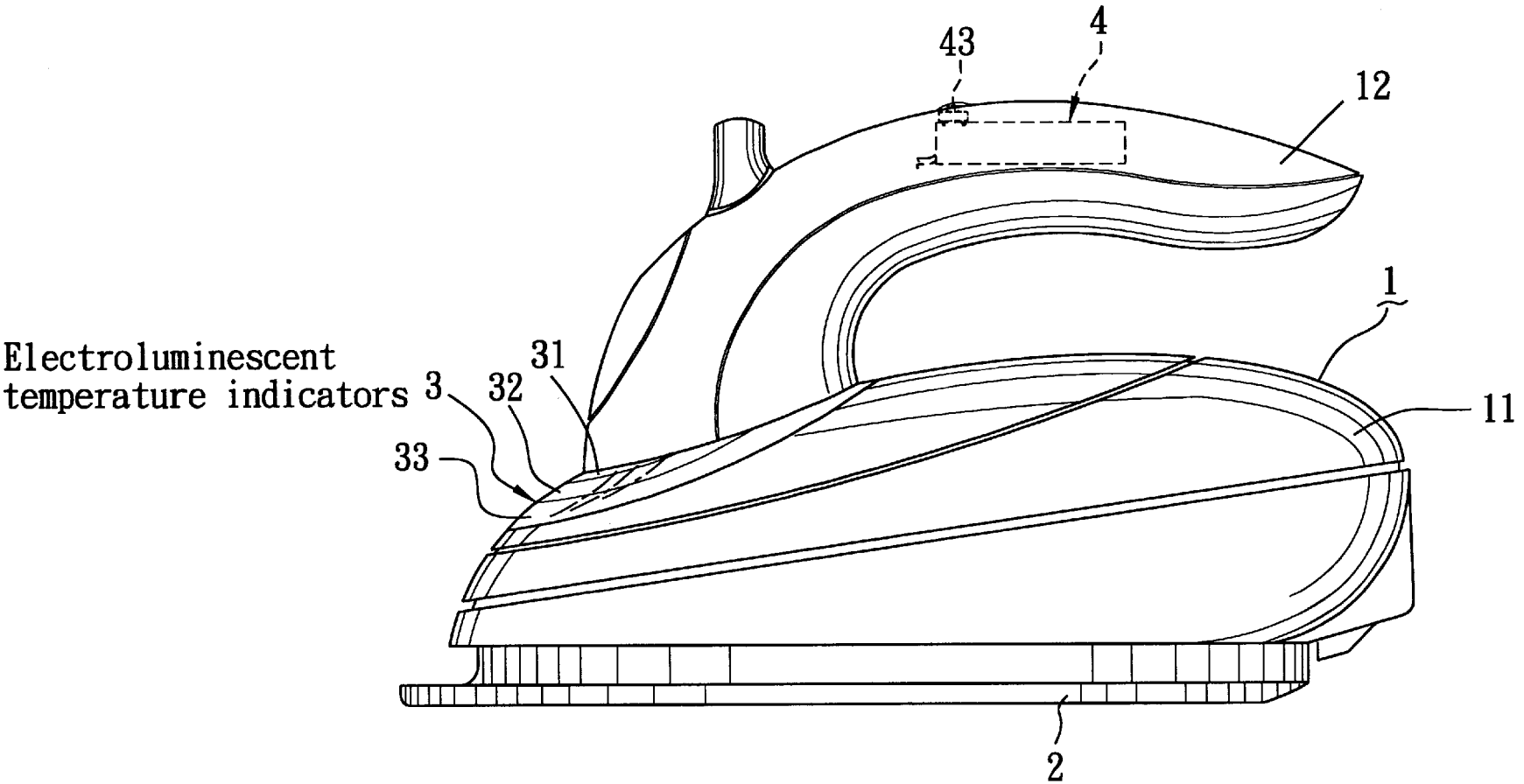
FIG. 1 is a schematic side view illustrating the preferred of a pressing iron according to the present invention.
Figure 2:
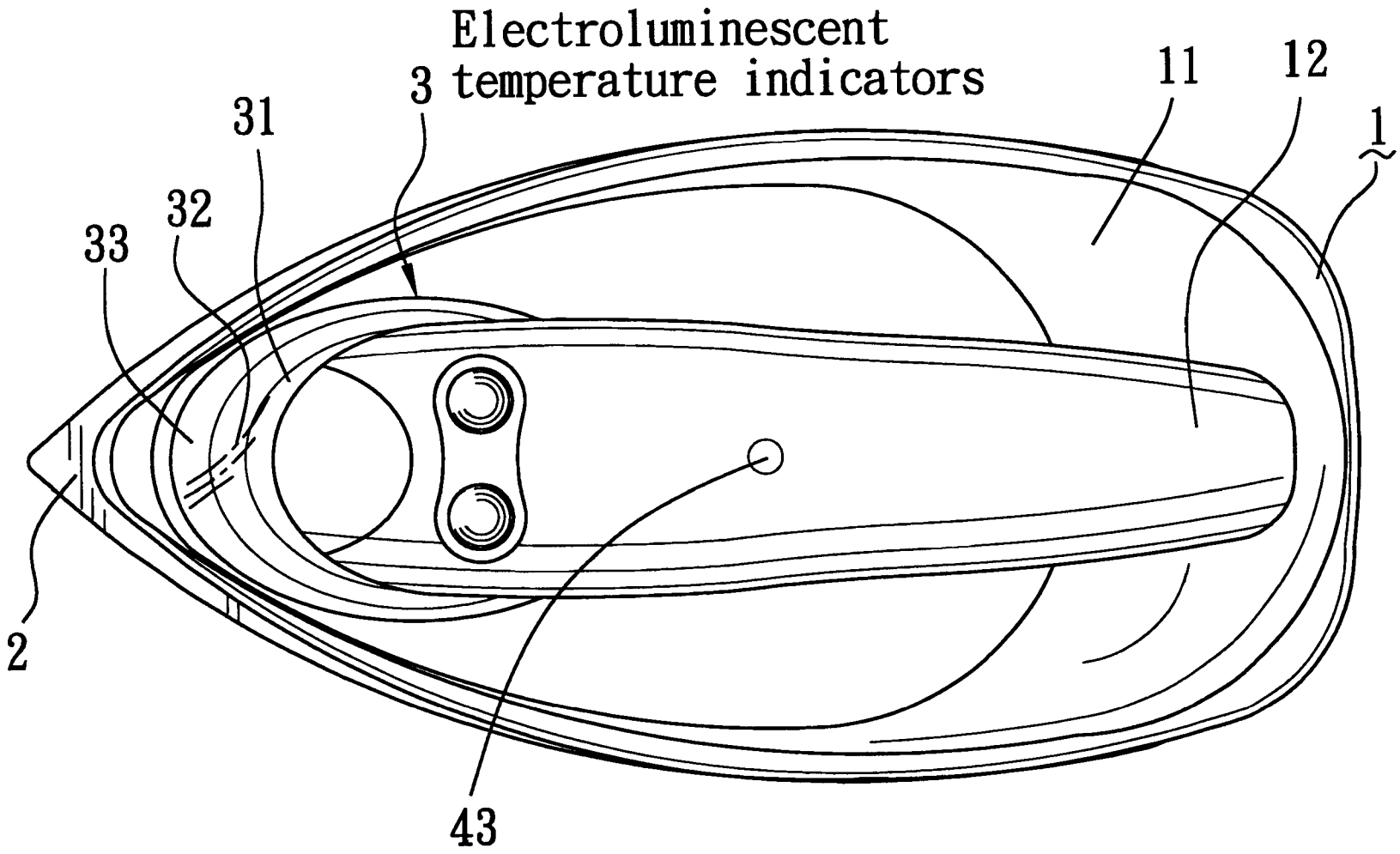
FIG. 2 is a schematic top view of the preferred embodiment.

Referring to FIGS. 1 and 2, the preferred embodiment of a pressing iron according to the present invention is shown to comprise a housing 1, a soleplate 2 mounted on a bottom portion of the housing 1, and electroluminescent temperature status indicator 3 mounted on an outer wall surface of the housing 1, and a control circuit 4 mounted in the housing 1 and coupled electrically to the soleplate 2 and the temperature status indicator 3 for controlling operation of the latter.

The housing 1 includes a housing body 11 and a handle 12. The housing body 11 has front and rear end portions, and tapers gradually from the rear end portion to the front end portion. The housing body 11 further has a top wall. The soleplate 2 is mounted on a bottom end of the housing body 11. The handle 12 extends upwardly and rearwardly from the top wall at the front end portion of the housing body 11.

In this embodiment, the temperature status indicator 3 includes first, second and third indicator members 31, 32, 33 that are mounted on the top wall of the housing body 11 and that are disposed in front of the handle 12. Each of the indicator members 31, 32, 33 is formed as an electroluminescent plate, which has a relatively low power consumption, and has a predetermined size and shape to configure the same with a contour conforming to that of the front end portion of the housing body 11. Because of the relatively large areas of the indicator members 31, 32, 33, the temperature status indicator 3 can provide a highly visible indicating effect. The indicator members 31, 32, 33 are arranged in sequence in a direction away from the handle 12.

Figure 3:
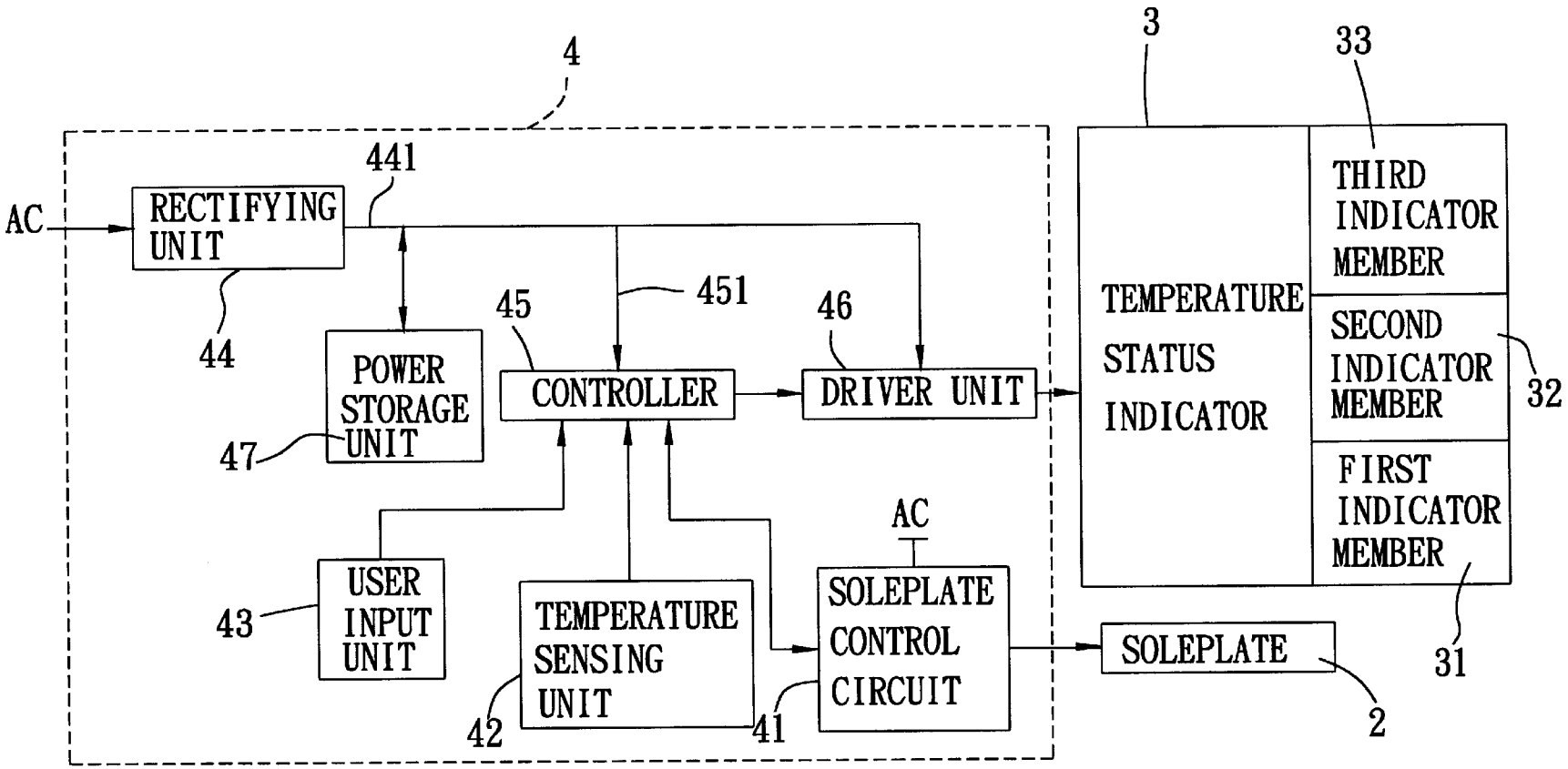
FIG. 3 is a schematic block diagram of the preferred embodiment.
Figure 4:
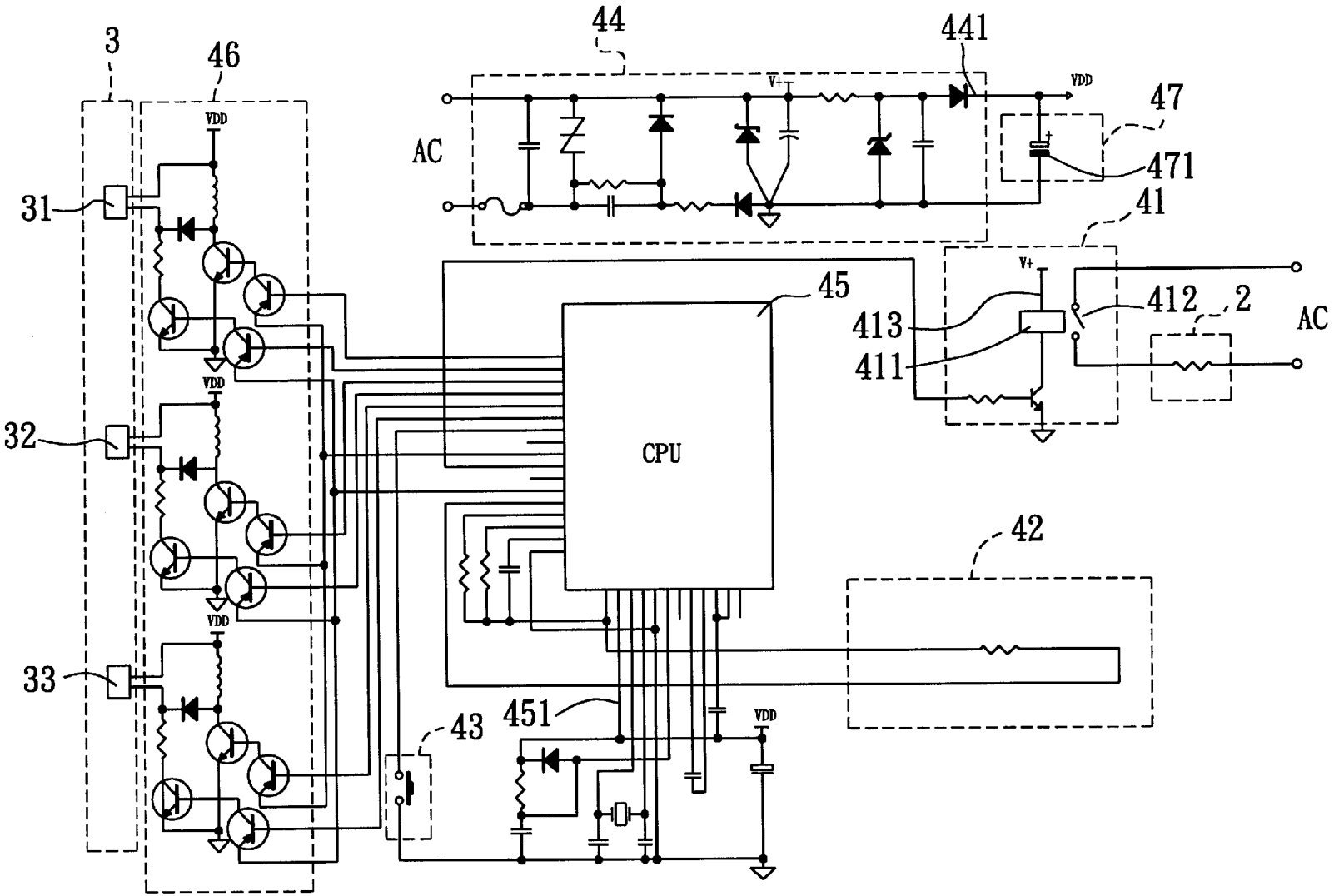
FIG. 4 is a schematic electrical circuit diagram of the preferred embodiment.

With further reference to FIGS. 3 and 4, the control circuit 4 is adapted to be connected to a commercial AC power source and is operable so as to drive the temperature status indicator 3 to generate a light output to result in a desired temperature indicating effect and so as to control the supply of electric power to the soleplate 2.

The control circuit 4 includes a soleplate control circuit 41 connected electrically to the soleplate 2 and operable so as to permit and interrupt the supply of electric power to the soleplate 2, a temperature sensing unit 42 associated with the soleplate 2 so as to detect an operating temperature of the soleplate 2 and so as to generate a temperature signal output corresponding to the operating temperature detected thereby, a user input unit 43 mounted on the housing 1 and operable so as to provide a user input signal, a rectifying unit 44 adapted to be connected to the commercial AC power source and to generate a direct current signal ($V_{DD}$) at an output terminal 441 thereof, a controller 45, such as a central processing unit (CPU), for controlling the operations of the soleplate control circuit 41 and the temperature status indicator 3, a driver unit 46 which interconnects the controller 45 and the temperature status indicator 3, which is connected to the output terminal 441 of the rectifying unit 44, and which is controlled by the controller 45 to drive operation of the temperature status indicator 3, and a power storage unit 47 connected to the output terminal 441 of the rectifying unit 44.

The soleplate control circuit 41 includes a relay unit 411 (see FIG. 4) connected to and activated by the controller 45. The relay unit 411 includes a contact set 412 interconnecting the soleplate 2 and the commercial AC power source. The relay unit 411 further has a power input terminal 413 that receives a voltage input (V+) from the rectifying unit 44. The voltage input (V+) is independent from the direct current signal ($V_{DD}$).

The temperature sensing unit 42 is disposed at an appropriate position so as to be able to detect the operating temperature of the soleplate 2, such as on a top surface of the soleplate 2. The temperature sensing unit 42 is connected to the controller 45 so that the temperature signal output of the former can be provided to the latter.

In this embodiment, the user input unit 43 is a push button switch that is mounted operably on a top side of the handle 12, as best shown in FIGS. 1 and 2. The user input unit 43 is connected to the controller 45 so that the controller 45 receives a trigger signal every time the user input unit 43 is operated by the user.

The controller 45 has a power input terminal 451 connected to the output terminal 441 of the rectifying unit 44. As such, electric power can be supplied to the controller 45 to permit operation of the same. The controller 45 is programmed beforehand such that the soleplate control circuit 41 and the driver unit 46 are activated in accordance with the trigger signal from the user input unit 43 and the temperature signal output from the temperature sensing unit 42. In this way, the supply of electric power to the soleplate 2 and the light emitting activity of the temperature status indicator 3 can be controlled.

Each time the controller 45 receives the trigger signal from the user input unit 43, the operating mode of the controller 45 will change. In the preferred embodiment, the controller 45 is programmed with a low-temperature first operating mode, a medium-temperature second operating mode, a high-temperature third operating mode and a power-off fourth operating mode.

The first operating mode is selected when the controller 45 receives a first trigger signal from the user input unit 43. The controller 45 further receives the temperature signal output of the temperature sensing unit 42. Upon detection by the controller 45 that the operating temperature of the soleplate 2 has yet to reach a preset low-temperature value in the controller 45, the controller 45 will activate the relay unit 411 of the soleplate control circuit 41. At this time, the contact set 412 is in a closed-circuit state so as to connect the soleplate 2 to the commercial AC power source, thereby commencing heating operation of the soleplate 2. At the same time, the controller 45 activates the driver unit 46 such that the first indicator member 31 of the temperature status indicator 3 will be driven to emit a blinking light output, thereby indicating low-temperature operation of the soleplate 2 and that the operating temperature of the soleplate 2 has yet to reach the preset low-temperature value.

Upon detection by the controller 45 that the operating temperature of the soleplate 2 has reached the preset low-temperature value, the controller 45 will deactivate the relay unit 411 of the soleplate control circuit 41. At this time, the contact set 412 is in an open-circuit state so as to disconnect the soleplate 2 from the commercial AC power source, there by disrupting the heating operation of the soleplate 2. At the same time, the controller 45 activates the driver unit 46 such that the first indicator member 31 of the temperature status indicator 3 will be driven to emit a constant light output, thereby indicating low-temperature operation of the soleplate 2 and that the operating temperature of the soleplate 2 has reached the preset low-temperature value.

Thereafter, upon detection by the controller 45 that the operating temperature of the soleplate 2 has dropped below the preset low-temperature value, the controller 45 will once again activate the relay unit 411 of the soleplate control circuit 41 so as to make connection between the soleplate 2 and the commercial AC power source in order to resume the heating operation of the soleplate 2, and will further activate the driver unit 46 such that the first indicator member 31 of the temperature status indicator 3 will be driven to emit the blinking light output.

The second operating mode is selected when the controller 45 receives a subsequent second trigger signal from the user input unit 43. Upon detection by the controller 45 that the operating temperature of the soleplate 2 has yet to reach a preset medium-temperature value in the controller 45, the controller 45 will activate the relay unit 411 of the soleplate control circuit 41. At this time, the contact set 412 is in the closed-circuit state so as to connect the soleplate 2 to the commercial AC power source, thereby commencing heating operation of the soleplate 2. At the same time, the controller 45 activates the driver unit 46 such that the first and second indicator members 31, 32 of the temperature status indicator 3 will be driven to emit a blinking light output, thereby indicating medium-temperature operation of the soleplate 2 and that the operating temperature of the soleplate 2 has yet to reach the preset medium-temperature value.

Upon detection by the controller 45 that the operating temperature of the soleplate 2 has reached the preset medium-temperature value, the controller 45 will deactivate the relay unit 411 of the soleplate control circuit 41. At this time, the contact set 412 is in the open-circuit state so as to disconnect the soleplate 2 from the commercial AC power source, there by disrupting the heating operation of the soleplate 2. At the same time, the controller 45 activates the driver unit 46 such that the first and second indicator members 31, 32 of the temperature status indicator 3 will be driven to emit a constant light output, thereby indicating medium-temperature operation of the soleplate 2 and that the operating temperature of the soleplate 2 has reached the preset medium-temperature value.

Thereafter, upon detection by the controller 45 that the operating temperature of the soleplate 2 has dropped below the preset medium-temperature value, the controller 45 will once again activate the relay unit 411 of the soleplate control circuit 41 so as to make connection between the soleplate 2 and the commercial AC power source in order to resume the heating operation of the soleplate 2, and will further activate the driver unit 46 such that the first and second indicator members 31, 32 of the temperature status indicator 3 will be driven to emit the blinking light output.

The third operating mode is selected when the controller 45 receives a subsequent third trigger signal from the user input unit 43. Upon detection by the controller 45 that the operating temperature of the soleplate 2 has yet to reach a preset high-temperature value in the controller 45, the controller 45 will activate the relay unit 411 of the soleplate control circuit 41. At this time, the contact set 412 is in the closed-circuit state so as to connect the soleplate 2 to the commercial AC power source, thereby commencing heating operation of the soleplate 2. At the same time, the controller 45 activates the driver unit 46 such that the first, second and third indicator members 31, 32, 33 of the temperature status indicator 3 will be driven to emit a blinking light output, thereby indicating high-temperature operation of the soleplate 2 and that the operating temperature of the soleplate 2 has yet to reach the preset high-temperature value.

Upon detection by the controller 45 that the operating temperature of the soleplate 2 has reached the preset high-temperature value, the controller 45 will deactivate the relay unit 411 of the soleplate control circuit 41. At this time, the contact set 412 is in the open-circuit state so as to disconnect the soleplate 2 from the commercial AC power source, thereby disrupting the heating operation of the soleplate 2. At the same time, the controller 45 activates the driver unit 46 such that the first, second and third indicator members 31, 32, 33 of the temperature status indicator 3 will be driven to emit a constant light output, thereby indicating high-temperature operation of the soleplate 2 and that the operating temperature of the soleplate 2 has reached the preset high-temperature value.

Thereafter, upon detection by the controller 45 that the operating temperature of the soleplate 2 has dropped below the preset high-temperature value, the controller 45 will once again activate the relay unit 411 of the soleplate control circuit 41 so as to make connection between the soleplate 2 and the commercial AC power source in order to resume the heating operation of the soleplate 2, and will further activate the driver unit 46 such that the first, second and third indicator members 31, 32, 33 of the temperature status indicator 3 will be driven to emit the blinking light output.

The fourth operating mode is selected when the controller 45 receives a subsequent fourth trigger signal from the user input unit 43. At this time, the controller 45 will deactivate, the relay unit 411 of the soleplate control circuit 41 such that the contact set 412 is in the open-circuit state in order to disconnect the soleplate 2 from the commercial AC power source, thereby terminating the heating operation of the soleplate 2. Moreover, in order to enhance awareness and improve safety, after the transition from the third operating mode to the fourth operating mode, as long as the operating temperature of the soleplate 2 is above the preset high-temperature value, the controller 45 activates the driver unit 46 such that the first, second and third indicator members 31, 32, 33 of the temperature status indicator 3 will be driven to emit a constant light output, and when the operating temperature of the soleplate 2 drops below the preset high-temperature value, the controller 45 activates the driver unit 46 such that the first, second and third indicator members 31, 32, 33 of the temperature status indicator 3 will be driven to emit a blinking light output. The purpose of such light emitting activity of the temperature status indicator 3 is to provide an indication to the user that the pressing iron is still connected to the commercial AC power source and to enhance awareness of the user as to the high-temperature state of the soleplate 2.

The generation of succeeding trigger signals by the user input unit 43 will enable sequential selection of the different operating modes of the controller 45.

The power storage unit 47 includes a capacitor 471 that is connected to the output terminal 441 of the rectifying unit 44. Accordingly, when the rectifying unit 44 receives electric power from the commercial AC power source, the power storage unit 47 will be charged to store back-up power therein. In the event that the supply of electric power from the commercial AC power source is interrupted, such as when the pressing iron is disconnected from the commercial AC power source, the rectifying unit 44 will be unable to provide the voltage input (V+) to the relay unit 411 of the soleplate control circuit 41. As such, the relay unit 411 is deactivated, and the contact set 412 is in the open-circuit state so as to disconnect the soleplate 2 from the commercial AC power source, thereby terminating the heating operation of the soleplate 2.

However, the back-up power stored in the power storage unit 47 will be sufficient to permit continued operation of the controller 45, the driver unit 46 and the temperature status indicator 3 for a short period of time after the supply of electric power from the commercial AC power source is interrupted. In other words, in the pressing iron of this invention, the temperature status indicator 3 can continue its light emitting activity for the short period of time after the supply of the electric power from the commercial AC power source is interrupted. For example, when the supply of electric power from the commercial AC power source is interrupted while the controller 45 is operating in the third operating mode, the power storage unit 47 can ensure continued light emitting activity of the temperature status indicator 3 for the short period of time so as to provide a highly visible indication to the user of the pressing iron as to the high-temperature state of the soleplate 2, thereby increasing awareness of the user as to the danger of coming into contact with the soleplate 2 while the latter is at the high-temperature state.

Upon interruption of the supply of electric power from the commercial AC power source, the light emitting activity of the temperature status indicator 3 is continued for the short period of time, which is sufficient to allow the soleplate 2 to cool down. Because the indicator members 31, 32, 33 are formed as electroluminescent plates, which consume a relatively small amount of electric power, by selecting the capacitance value of the capacitor 471, the continued light emitting activity of the temperature status indicator 3 can be controlled to be as long as twenty minutes. The soleplate 2 is fully cooled at the end of the twenty-minute period.

Note that, if the indicator members 31, 32, 33 are replaced by light emitting diodes, since light emitting diodes have a larger power consumption as compared to electroluminescent plates, assuming that the capacitance value of the capacitor 471 remains unchanged, the allowable continued light emitting activity of the temperature sensing unit will be about ten minutes or about 50% shorter. Therefore, aside from the advantage of providing a relatively large light emitting area for enhancing the temperature indicating effect, the lower power consumption of the electroluminescent plates as compared to light emitting diodes enables continued light emitting activity using the back-up power stored in the-power storage unit 47 for a longer amount of time.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A pressing iron comprising:

a housing having a bottom portion and an outer wall surface;

a soleplate mounted on said bottom portion of said housing;

an electroluminescent temperature status indicator mounted on said outer wall surface of said housing, said temperature status indicator including at least one indicator member that is formed as an electroluminescent plate; and a control circuit mounted in said housing and coupled electrically to said soleplate and said temperature status indicator, said control circuit controlling heating operation of said soleplate, said control circuit further controlling light emitting activity of said temperature status indicator.

2. The pressing iron of claim 1, wherein said temperature status indicator includes a number of said indicator members, each of which is activated by said control circuit to emit light according to operating temperature of said soleplate.

3. The pressing iron of claim 2, wherein said indicator members include first, second and third indicator members, said control circuit activating said first indicator member when said control circuit operates in a low-temperature operating mode, said control circuit activating said first and second indicator members when said control circuit operates in a medium-temperature operating mode, said control circuit activating said first, second and third indicator members when said control circuit operates in a high-temperature operating mode.

4. The pressing iron of claim 2, wherein said housing includes a housing body with front and rear end portions, said housing body tapering gradually from said rear end portion to said front end portion, said housing body having a top wall, said housing further including a handle that extends upwardly and rearwardly from said top wall at said front end portion of said housing body, said indicator members being mounted on said top wall and being disposed in front of said handle, each of said indicator members having a contour conforming to that of said front end portion of said housing body, said indicator members being arranged in sequence in a direction away from said handle.

* * * * *